US008660286B2

(12) United States Patent
He et al.

(10) Patent No.: US 8,660,286 B2
(45) Date of Patent: Feb. 25, 2014

(54) SPEAKER SYSTEM

(75) Inventors: Jing He, Shenzhen (CN); Qian Xu, Shenzhen (CN)

(73) Assignees: AAC Acoustic Technologies (Shenzhen) Co., Ltd., Shenzhen (CN); American Audio Components Inc., La Verne, CA (US)

( * ) Notice: Subject to any disclaimer, the term of this patent is extended or adjusted under 35 U.S.C. 154(b) by 85 days.

(21) Appl. No.: 13/190,077

(22) Filed: Jul. 25, 2011

(65) Prior Publication Data

US 2012/0093350 A1 Apr. 19, 2012

(30) Foreign Application Priority Data

Oct. 13, 2010 (CN) ..... 2010 2 0559761 U

(51) Int. Cl.
*H04R 1/02* (2006.01)

(52) U.S. Cl.
USPC ..... 381/332; 381/91; 381/111; 381/122

(58) Field of Classification Search
USPC ..... 381/332, 360–361, 375, 396, 412, 420; 455/575.1, 575.3–575.4
See application file for complete search history.

(56) References Cited

U.S. PATENT DOCUMENTS

| | | | | |
|---|---|---|---|---|
| 5,823,820 | A * | 10/1998 | Patel et al. | 439/500 |
| 7,403,611 | B1 * | 7/2008 | He et al. | 379/420.01 |
| 2006/0116180 | A1 * | 6/2006 | Minervini | 455/575.1 |
| 2010/0177904 | A1 * | 7/2010 | Sung et al. | 381/71.6 |
| 2011/0064238 | A1 * | 3/2011 | Haas | 381/71.6 |
| 2011/0194721 | A1 * | 8/2011 | Schmidt et al. | 381/370 |

* cited by examiner

*Primary Examiner* — Brian Ensey
*Assistant Examiner* — Sabrina Diaz
(74) *Attorney, Agent, or Firm* — Anova Law Group, PLLC

(57) ABSTRACT

A speaker system includes a case defining a center hole and a body surrounding the center hole, an electroacoustic transducer received in the center hole of a case, and a microphone. The body of the case defines a sidewall, a bottom extending outwards from the sidewall, and a projecting element extending upwardly from the bottom and opposite to the sidewall. A slot is formed between the projecting element and the sidewall, and the microphone is positioned in the slot.

5 Claims, 6 Drawing Sheets

SPEAKER SYSTEM

FIELD OF THE INVENTION

The present disclosure generally relates to the art of speaker systems, and more particularly, to a speaker system with the function of noise cancelling.

RELATED ART OF THE INVENTION

Speakers are widely used in many types of portable electronic devices, such as mobile phones, notebook computers, and hearing aids, for converting audio electrical signals to audible sounds.

To improve the sound quality of a speaker unit, a microphone unit and a noise cancelling circuit are provided and attached to the speaker unit so as to form an integrated speaker system. The microphone unit is used for receiving the environmental noise signals, and the noise cancelling circuit is used for dealing with noise signals, therefore, the speaker system can allows the user to listen clearly in a noisy environment. But, generally, the microphone unit is attached to the speaker unit by glue, so, the connection between the microphone unit and the speaker unit is unstable, and it is difficult to assemble the microphone to the speaker conveniently.

Therefore, an improved speaker system that can resolve the problems mentioned-above is desired.

DETAILED DESCRIPTION OF THE EXEMPLARY EMBODIMENT

Reference will now be made to describe one exemplary embodiment of the present invention in detail.

Figure 1:
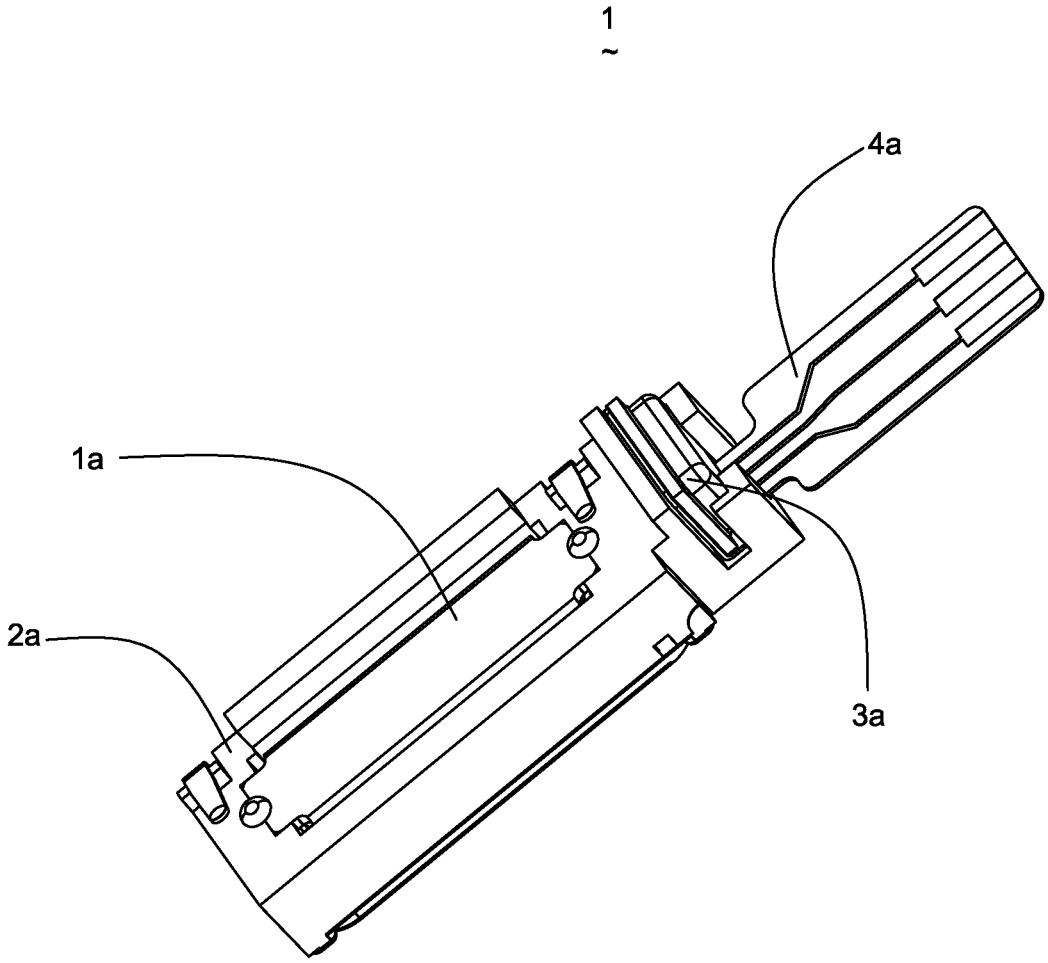
FIG. 1 depicts an isometric assembled view of a speaker system in accordance with one exemplary embodiment of the present invention.
Figure 2:
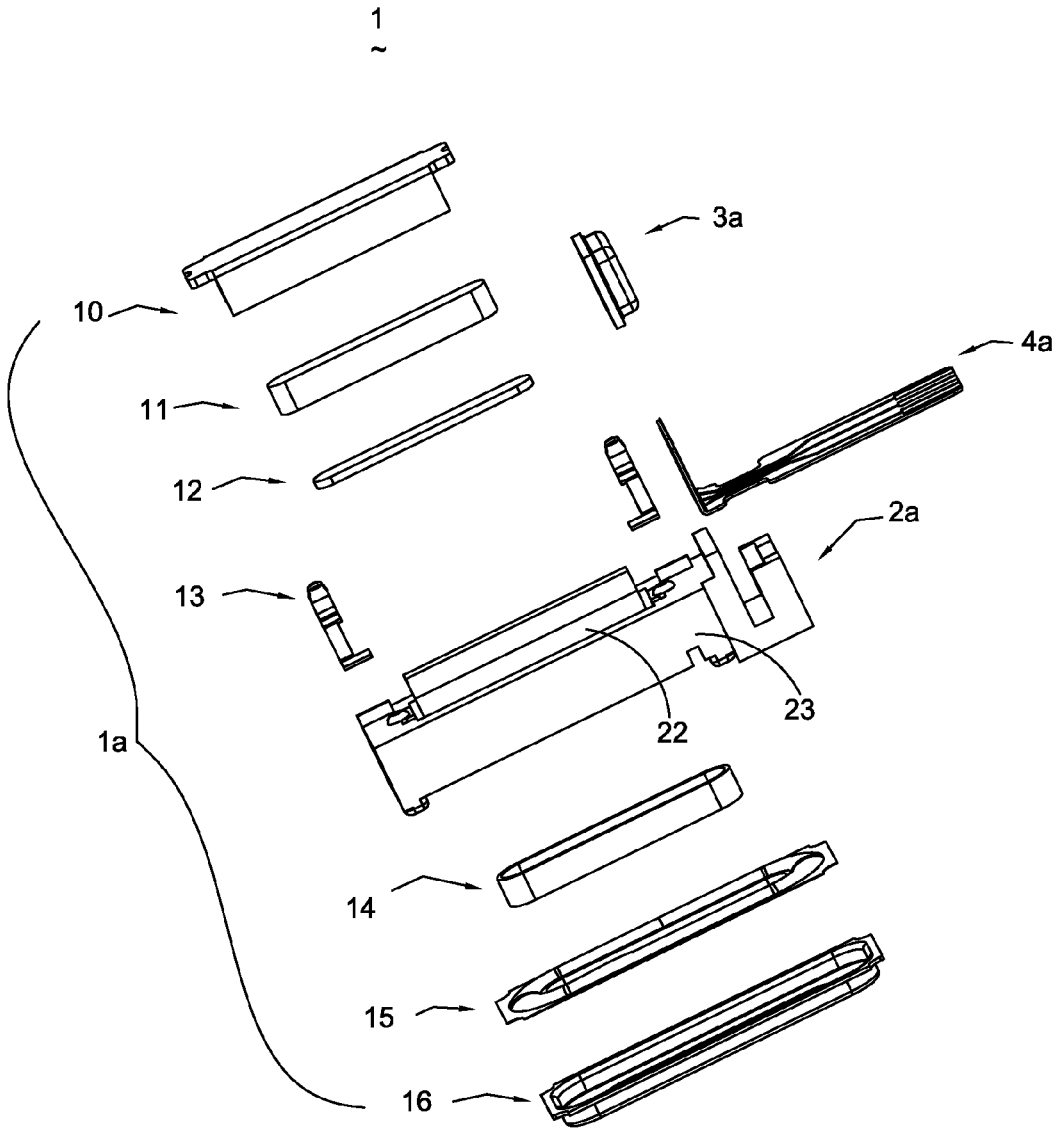
FIG. 2 depicts an isometric exploded view of the speaker system in FIG. 1.
Figure 3:
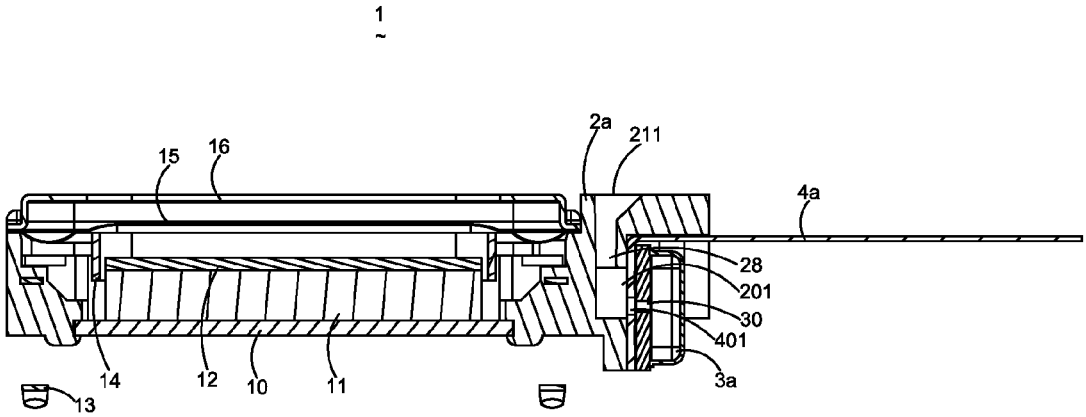
FIG. 3 depicts a cross-sectional view of the speaker system in FIG. 1.

Referring to FIGS. 1-3, a speaker system 1, in accordance with an exemplary embodiment of the present invention, includes an electroacoustic transducer 1*a*, a case 2*a* for receiving the electroacoustic transducer 1*a*, and a microphone 3*a*.

The electroacoustic transducer 1*a*, for converting audio electrical signals to audible sounds, includes a yoke 10, a magnet 11 fixed to the yoke 10, a plate 12 attached to the magnet 11, a coil 14 suspended in a magnetic gap formed between the yoke 10 and the magnet 11, a diaphragm 15 connected to the coil 14, a upper cover 16 facing to the diaphragm 15 for preventing the diaphragm 15 and a pair of terminals 13 electrically connected to the coil 14. One end of the coil 14 is suspended in the magnetic gap, and another end of the coil 14 is connected to the diaphragm 15. When electrified, the coil 14 is forced to move and drive the diaphragm 15 to vibrate for producing sound waves.

In fact, the electroacoustic transducer 1*a* is not limited to the structures described above, and can make the present invention practical as long as it is capable of converting electrical signals into audible sounds.

Figure 4:
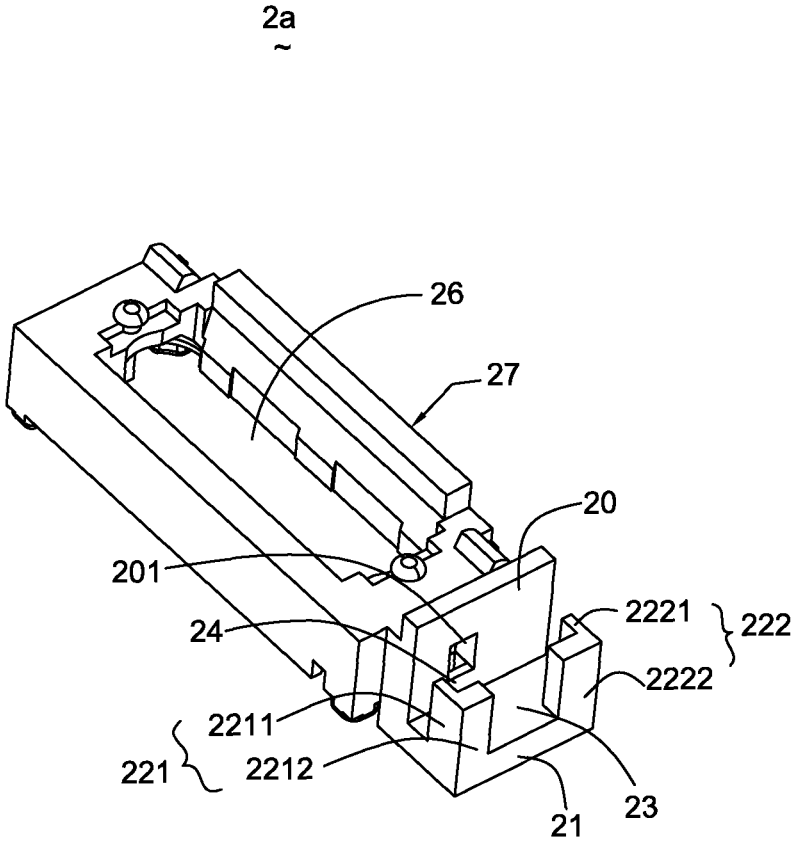
FIG. 4 depicts an isometric view of a case of the speaker system.
Figure 5:
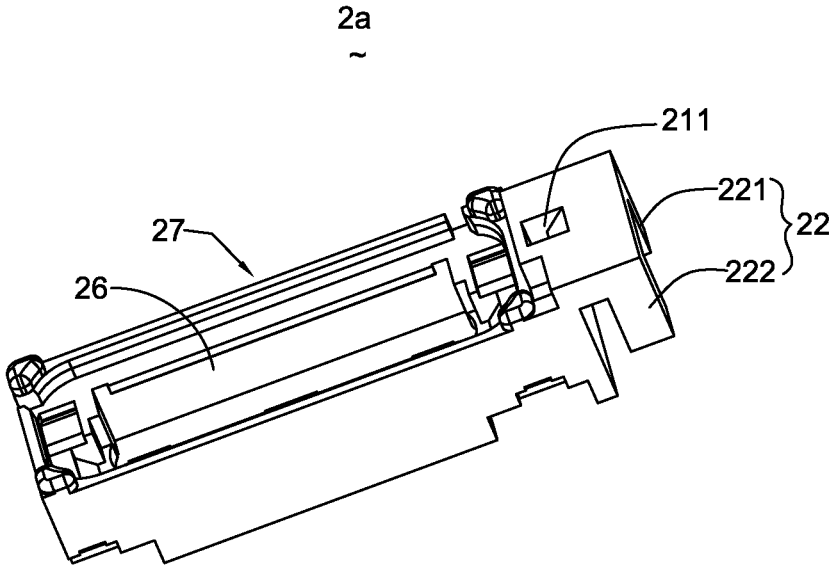
FIG. 5 depicts an isometric view of the case in FIG. 4, from another aspect.

Referring to FIGS. 4-5 together, the case 2*a* defines a center hole 26 and a body 27 surrounding the center hole 26. Then, the electroacoustic transducer 1*a* is received in the center hole 26 of the case 2*a*.

The body 27 of the case 2*a* defines a sidewall 20, a bottom 21 extending outwards from the sidewall 20, and a projecting element 22 extending upwardly from the bottom 21 and opposite to the sidewall 22. Furthermore, the bottom 21 is approximately upright to the sidewall 20, and the projecting element 22 is approximately upright to the bottom 21. A slot 24 is provided between the projecting element 22 and the sidewall 20 for receiving the microphone 3*a* therein.

The projecting element 22 includes a first portion 221, a second portion 222, and a notch 23 between the first portion 221 and the second portion 222. The first portion 221 includes a first side 2211 upright to the sidewall 20 and a second side 2212 upright to the first side 2211 and parallel to the sidewall 20. The second portion 222 includes a third side 2221 upright to the sidewall 20 and a fourth side 2222 upright to the third side 2221 and parallel to the sidewall 20. At the same time, the notch 23 is formed between the second side 2212 and the fourth side 2222, and the slot 24 is formed between the sidewall 20 and the second side 2212 together with the fourth side 2222, and the first side 2211 and third side 2221 extend towards the sidewall 20 for partially enclosing the slot 24. Therefore, the microphone 3*a* can be stably positioned in the slot 24.

Figure 6:
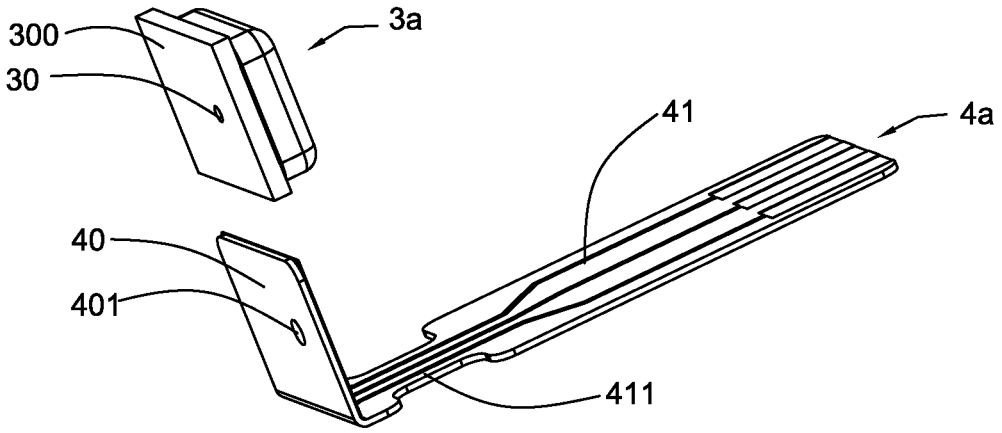
FIG. 6 depicts an isometric view of a microphone ready to be mounted onto a PCB.

Referring to FIG. 6, a bottom 300 of the microphone 3*a* defines an opening hole 30, so that the external sound waves can enter into the microphone 3*a*.

In the embodiment, the bottom 300 of the microphone 3*a* is positioned towards the sidewall 20. A first hole 201 is provided on a surface of the sidewall 20. A second hole 211 is provided on a surface of the bottom 21. And a inward channel 28 is provided in the sidewall 20 for communicating the first hole 201 with the second hole 211. Therefore, the opening hole 30 of the microphone 3*a* can be communicated with the environment air.

In the embodiment, the speaker system furthermore includes a PCB 4*a* for providing electrical signals to the microphone 3*a* and being electrically connected to an external circuit. The PCB 4*a* includes a first plate 40 and a second plate 41 approximately upright to the first plate 40. The first plate 40 is attached to the bottom 300 of the microphone 3*a* and positioned between the sidewall 20 and the microphone 3*a*. And, the second plate 41 is positioned between the microphone 3*a* and the bottom 21 and extends outwardly from the notch 23. The second plate defines a narrow portion 411 is positioned in the notch 23.

Furthermore, the first plate 40 of the PCB 4*a* defines a third hole 401 communicating with the opening hole 30 of the microphone 3*a* and first hole 201. So, the external sound waves firstly get into the second hole 211, and pass the inward channel 28, the first hole 201 and the third hole 401 of the PCB, then finally, enter the opening hole 30 of the microphone 3*a*.

In order to position the microphone 3*a* and the PCB 4*a* in the slot 24 firmly, a width of the slot 24 is not bigger than a summation of a thickness of the first plate 40 of the PCB 4*a* and a thickness of the microphone 3*a*.

While the present invention has been described with reference to a specific embodiment, the description of the invention is illustrative and is not to be construed as limiting the invention. Various of modifications to the present invention can be made to the exemplary embodiment by those skilled in the art without departing from the true spirit and scope of the invention as defined by the appended claims.

What is claimed is:

1. A speaker system, comprising:

a case defining a center hole and a body surrounding the center hole, the body including a sidewall defining a first hole;

an electroacoustic transducer received in the center hole of the case;

a microphone defining an opening hole;

the body of the case further defining a bottom extending outwards from the sidewall, the bottom including a second hole;

a projecting element extending upwardly from the bottom and opposite to the sidewall;

a slot formed between the projecting element and the sidewall for receiving the microphone therein;

an inward channel defined in the sidewall for communicating the first hole with the second hole; wherein the opening hole of the microphone faces the inward channel in the sidewall for communicating with the environment air; and a PCB defines a first plate positioned between the microphone and the sidewall and a second plate positioned between the microphone and the bottom, the first plate defining a third hole communicating with the opening hole of the microphone and the first hole.

2. The speaker system as described in claim 1, wherein the projecting element comprises a first portion, a second portion, and a notch between the first portion and the second portion.

3. The speaker system as described in claim 2, wherein the first portion comprises a first side towards the sidewall and a second side parallel to the sidewall and upright to the first side.

4. The speaker system as described in claim 3, wherein the second portion comprises a third side towards the sidewall and a fourth side parallel to the sidewall and upright to the first side.

5. The speaker system as described in claim 4, wherein the second plate further defines a narrow portion positioned in the notch.

* * * * *